US008707509B2

(12) United States Patent
White et al.

(10) Patent No.: US 8,707,509 B2
(45) Date of Patent: Apr. 29, 2014

(54) SURFACE TREATING APPLIANCE

(75) Inventors: William Robert James White, Malmesbury (GB); James White, Malmesbury (GB); Adam William Rollo, Malmesbury (GB); David Christopher James Newton, Malmesbury (GB); Christopher Thomas Watson, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 288 days.

(21) Appl. No.: 13/416,881

(22) Filed: Mar. 9, 2012

(65) Prior Publication Data

US 2012/0233808 A1 Sep. 20, 2012

(30) Foreign Application Priority Data

Mar. 15, 2011 (GB) ..... 1104368.4

(51) Int. Cl.
*A47L 9/24* (2006.01)
*A47L 5/12* (2006.01)

(52) U.S. Cl.
USPC ..... 15/331; 329/334

(58) Field of Classification Search
CPC ..... A47L 5/32; A47L 5/225; A47L 5/30; A47L 5/28; A47L 9/0036; A47L 9/02; A47L 9/242; A47L 9/0653; A47L 11/34
USPC ..... 15/350, 415.1, 331, 334, 328, 329
See application file for complete search history.

(56) References Cited

U.S. PATENT DOCUMENTS

| | | | | |
|---|---|---|---|---|
| 6,572,078 | B1 | 6/2003 | Thomson et al. | |
| 7,823,251 | B2 * | 11/2010 | Dyson et al. | 15/336 |
| 8,539,636 | B2 * | 9/2013 | White et al. | 15/323 |
| 2010/0251504 | A1 | 10/2010 | Lee et al. | |
| 2011/0088202 | A1 * | 4/2011 | McLuckie et al. | 15/329 |
| 2011/0088206 | A1 * | 4/2011 | Ford et al. | 15/363 |

FOREIGN PATENT DOCUMENTS

| | | |
|---|---|---|
| EP | 1 121 043 | 8/2001 |
| GB | 2469363 | 10/2010 |
| GB | 2474471 | 4/2011 |
| JP | 2002-527131 | 8/2002 |
| WO | WO-2008/037955 | 4/2008 |

OTHER PUBLICATIONS

Search Report and Written Opinion mailed Jun. 14, 2012, directed to International Application No. PCT/GB2012/050339; 18 pages.
GB Search Report dated Jul. 14, 2011, directed to GB Application No. 1104368.4; 1 page.

* cited by examiner

*Primary Examiner* — Dung Van Nguyen
(74) *Attorney, Agent, or Firm* — Morrison & Foerster LLP

(57) ABSTRACT

A surface treating appliance includes a surface treating head, a hose, and a fan unit for generating a flow of fluid. A flexible duct assembly has a first end and a second end moveable relative to the first end between a first position allowing fluid flow between the hose and the fan unit, and a second position allowing fluid flow between the surface treating head and the fan unit. The duct assembly is connected to a first support which is pivotable about a first axis, and to a second support which is pivotable about a second axis spaced from the first axis. A drive mechanism effects the pivoting movement of the supports about their axes to move the second end of the duct assembly between the first and second positions.

18 Claims, 12 Drawing Sheets

SURFACE TREATING APPLIANCE

REFERENCE TO RELATED APPLICATIONS

This application claims the priority of United Kingdom Application No. 1104368.4, filed Mar. 15, 2011, the entire contents of which are incorporated herein by reference.

FIELD OF THE INVENTION

The present invention relates to a surface treating appliance.

BACKGROUND OF THE INVENTION

Surface treating appliances such as vacuum cleaners are well known. The majority of vacuum cleaners are either of the "upright" type or of the "cylinder" type (also referred to canister or barrel machines in some countries). An upright vacuum cleaner typically comprises a main body containing dirt and dust separating apparatus, a pair of wheels mounted on the main body for maneuvering the vacuum cleaner over a floor surface to be cleaned, and a cleaner head mounted on the main body. The cleaner head has a downwardly directed suction opening which faces the floor surface. The vacuum cleaner further comprises a motor-driven fan unit for drawing dirt-bearing air through the suction opening. The dirt-bearing air is conveyed to the separating apparatus so that dirt and dust can be separated from the air before the air is expelled to the atmosphere. The separating apparatus can take the form of a filter, a filter bag or a cyclonic arrangement.

In use, a user reclines the main body of the vacuum cleaner towards the floor surface, and then sequentially pushes and pulls a handle which is attached to the main body of the cleaner to maneuver the vacuum cleaner over the floor surface. The dirt-bearing air flow drawn through the suction opening by the fan unit is conducted to the separating apparatus by a first air flow duct. When dirt and dust has been separated from the air flow, the air flow is conducted to a clean air outlet by a second air flow duct. One or more filters may be provided between the separating apparatus and the clean air outlet.

An example of an upright vacuum cleaner is described in WO2008/037955. The main body of the vacuum cleaner is moveable between an upright position and a reclined position for maneuvering over a floor surface to be cleaned. The vacuum cleaner comprises a stand which is moveable relative to the main body between a supporting position for supporting the main body in its upright position, and a retracted position so that the stand does not interfere with the maneuvering of the vacuum cleaner over the floor surface. The vacuum cleaner also comprises a hose and wand assembly connected to the main body through which air can be drawn into the vacuum cleaner and a changeover valve which is moveable to connect either the hose and wand assembly or the cleaner head to the fan unit.

The changeover valve comprises a casing which houses a cylindrical drum. The casing comprises a first fluid inlet connected to the hose and wand assembly, a second fluid inlet connected to the cleaner head and a fluid outlet connected to the fan unit. The drum comprises a fluid inlet located on a side wall thereof, and a fluid outlet located on an end wall thereof. A wheel is connected to the drum to rotate the drum within the casing so that the fluid inlet of the drum is connected to a selected one of the fluid inlets of the casing. The wheel is rotated by the stand as the stand moves between its supporting and retracted positions. When the stand is in its supporting position the fluid inlet of the drum is connected to the hose and wand assembly, whereas when the stand is in its retracted position the fluid inlet of the drum is connected to the cleaner head.

SUMMARY OF THE INVENTION

The present invention provides a surface treating appliance comprising a surface treating head, a hose, a fan unit for generating a flow of fluid, a duct assembly having a first end and a second end moveable relative to the first end between a first position allowing fluid flow between the hose and the fan unit, and a second position allowing fluid flow between the surface treating head and the fan unit, a plurality of supports for supporting the duct, comprising a first support connected to the duct assembly and which is pivotable about a first axis, and a second support connected to the duct assembly and which is pivotable about a second axis spaced from the first axis, and drive means for effecting the pivoting movement of the supports about their axes to move the second end of the duct assembly between the first and second positions.

The pivoting movement of the supports about different respective axes means that the different parts of the duct assembly to which the supports are connected sweep respective different arcuate paths as the second end of the duct assembly moves between the first and second positions. This can assist in the breaking of a seal between the duct assembly and, for example, a body within which the duct assembly is moveable. This can lead to a reduction in the force required to move the second end of the duct assembly between its first and second positions, and can also enhance the lifetime of the seal.

The duct assembly preferably comprises a first connector for connecting the duct to the first support, and a second connector for connecting the duct to the second support. In a preferred embodiment, each connector comprises a female connector for receiving a male connector located on a respective one of the supports. These connectors may be reversed, with each part of the duct assembly comprising a male connector for connection to a female connector located on a respective one of the supports.

The connectors are preferably located on opposite sides of the duct assembly to assist in maintaining the shape of the duct assembly as the second end is moved between the first and second positions. Where the duct assembly has a generally circular cross-section, the connectors are preferably located on diametrically opposed parts of the duct assembly. The connectors are preferably located at or towards the second end of the duct so that the supports can guide this end of the duct assembly into the first and second positions. The duct assembly preferably comprises a flexible duct.

A seal carrier may be connected to one end of the duct, and an annular seal connected to the seal carrier and located at the second end of the duct assembly. In this case, the connectors may be attached to, or integral with, the seal carrier. The seal carrier may be overmolded with the flexible duct. An additional seal carrier may be connected to the other end of the duct, and another annular seal connected to this additional seal carrier and located at the first end of the duct assembly.

The first end of the duct assembly is preferably maintained in a stationary position as the second end of the duct assembly moves between its first and second positions. For example, the additional seal carrier or the additional seal may be secured to part of the appliance.

As another alternative, the duct assembly may comprise a single component which includes a flexible duct, seals at either end of the duct, and connectors for connecting the duct assembly to the supports. This component may be manufactured using a blow molding technique, for example.

Preferably, the first axis and the second axis are substantially parallel. Each connector may extend substantially parallel to the first and second axes.

Each support may comprise a single component, or a plurality of interconnected components. The supports are preferably located on opposite sides of the duct assembly so that each support is free to move about its respective axis without coming into contact with the other support. The supports may have the same length, or they may have different lengths. The first and second axes may be located at any convenient positions depending on the location of the various fluid inlets and outlets which are to be selectively placed in fluid communication by the duct assembly. For example the first axis may be located above the second axis. The first axis may be located above the duct assembly. The second axis may be located beneath the duct, or pass through the duct assembly.

The drive means preferably comprises a drive member for inducing pivoting movement of the first support about the first axis, which in turn causes the second end of the duct assembly to move between its first and second positions. In this case, the movement of the second support about the second axis is driven by the movement of the second end of the duct assembly. As a first alternative, the drive member may induce pivoting movement of the second support about the second axis, which in turn causes the second end of the duct assembly to move between its first and second positions. In this case, the movement of the first support about the first axis is driven by the movement of the second end of the duct assembly. As a second alternative, the drive means may comprise a gear arrangement or other arrangement of interconnected members connected to both the first and second supports for driving simultaneous rotation of the supports about their respective axes.

The drive member may be connected to a switch which is actuable by a user of the appliance to effect movement of the second end of the duct between its first and second positions. Alternatively, the drive member may be connected to or form part of a wand which is moveable within the hose of the appliance between retracted and extended positions. The end of the wand may engage the support, or a component connected to the support, as it moves between its retracted and extended positions to induce movement of the first support.

In a preferred embodiment, the drive member is located on a stand of the appliance, with the drive member being arranged to induce pivoting movement of the supports with relative movement between the stand and the supports. For example, the stand may induce the movement of the supports as the stand moves relative to the supports between a supporting position for supporting the appliance and a retracted position. The stand may be moveable from the supporting position to the retracted position automatically in response to a force being applied to the appliance to recline a main body of the appliance from an upright position to a reclined position. Alternatively, the stand may induce the movement of the supports as the main body of the appliance, bearing the supports, is moved relative to the stand from an upright position to a reclined position.

The drive member may comprise a drive pin arranged to engage a slot or other profiled surface on the first support as the stand moves relative to the supports to effect pivoting movement of the first support about the first axis. Alternatively, this slot or surface may be located on a separate component which is connected to the first component, for example by a gear arrangement.

The appliance preferably comprises a body having a first port in fluid communication with the surface treating head, a second port in fluid communication with the hose, and a third port in fluid communication with the fan unit. The second end of the duct assembly is preferably biased against the body both when in its first position, in which the seal is seated over the second port, and when in its second position, in which the seal is seated over the first port. This can inhibit the leakage of fluid between the body and the duct assembly.

The first end of the duct assembly is preferably rigidly connected to the body. For example, the second seal carrier may be connected to the body so that the second seal is both seated over the third port and compressed against the body to maintain a fluid tight seal therebetween. The ports of the body are spaced about a path, with both the first axis and the second axis being spaced from the center of the path. The body may be connected to a casing housing the fan unit. For example, the body may form part of the casing housing the fan unit. Alternatively, the body may be separate from the casing housing the fan unit The appliance preferably comprises biasing means for biasing the second end of the duct assembly towards the first and second positions. The biasing means may be connected to the connectors for connecting the duct assembly to the supports, or to the seal carrier bearing the connectors. Preferably, the biasing means comprises a first resilient member connected to the first support, and a second resilient member connected to the second support. At least one of the resilient members may comprise an over-center spring, which may be in the form of a torsion spring which biases the second end of the duct assembly towards either the first position or the second position depending on the location of the second end of the duct assembly relative to these two positions. For example, one end of the spring may be connected to the body and the other end of the spring may be connected to one of the supports.

Alternatively, or additionally, at least one of the resilient members may comprise a compression spring arranged to bias the second end of the duct assembly towards either the first position or the second position depending on the location of the second end of the duct assembly relative to these two positions.

As another alternative, the second end of the duct assembly may be biased towards one of the first and second positions through the compression of the flexible duct of the duct assembly when the duct assembly is in that position. In this case, the resilience of the flexible duct serves to urge the second end of the duct assembly against the body of the appliance to maintain a seal between the duct assembly and the body.

The appliance preferably comprises separating apparatus located downstream from the duct for separating dirt from a fluid flow. The separating apparatus is preferably in the form of a cyclonic separating apparatus having at least one cyclone, and which preferably comprises a chamber for collecting dirt separated from the air flow. Other forms of separator or separating apparatus can be used and examples of suitable separator technology include a centrifugal separator, a filter bag, a porous container or a liquid-based separator.

The term "surface treating appliance" is intended to have a broad meaning, and includes a wide range of machines having a head for travelling over a surface to clean or treat the surface in some manner. It includes, inter alia, machines which apply suction to the surface so as to draw material from it, such as vacuum cleaners (dry, wet and wet/dry), as well as machines which apply material to the surface, such as polishing/waxing machines, pressure washing machines, ground marking machines and shampooing machines. It also includes lawn mowers and other cutting machines.

BRIEF DESCRIPTION OF THE DRAWINGS

An embodiment of the present invention will now be described, by way of example only, with reference to the accompanying drawings, in which.

DETAILED DESCRIPTION OF THE INVENTION

Figure 1:
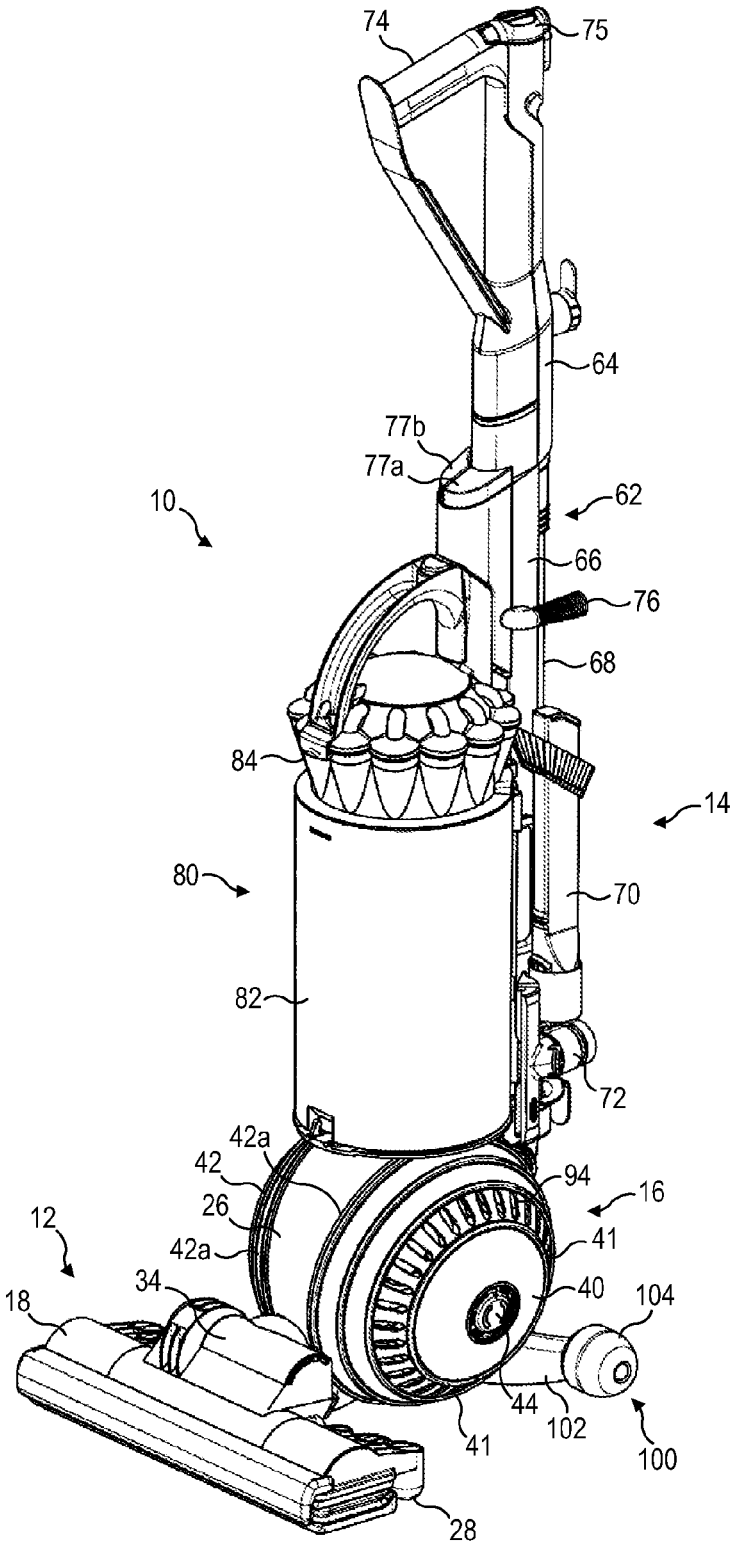
FIG. 1 is a front perspective view, from the left, of an upright vacuum cleaner.

FIGS. 1 to 4 illustrate an upright surface treating appliance, which is in the form of an upright vacuum cleaner. The vacuum cleaner 10 comprises a cleaner head 12, a main body 14 and a support assembly 16. In the FIGS. 1, 2*a*, 3 and 4, the main body 14 of the vacuum cleaner 10 is in an upright position relative to the cleaner head 12, whereas in FIG. 2*b* the main body 14 is in a fully reclined position relative to the cleaner head 12.

The cleaner head 12 comprises a housing 18 and a lower plate, or sole plate 20, connected to the housing 18. The sole plate 20 comprises a suction opening 22 through which a dirt-bearing air flow enters the cleaner head 12. The sole plate 20 has a bottom surface which, in use, faces a floor surface to be cleaned, and which comprises working edges for engaging fibers of a carpeted floor surface. The housing 18 defines a suction passage extending from the suction opening 22 to a fluid outlet 24 located at the rear of the housing 18. The fluid outlet 24 is dimensioned to connect to a yoke 26 for connecting the cleaner head 12 to the main body 14 of the vacuum cleaner 10. The lower surface of the cleaner head 12 can include small rollers 28 to ease movement of the cleaner head 12 across the floor surface.

The cleaner head 12 comprises an agitator for agitating dirt and dust located on the floor surface. In this example the agitator comprises a rotatable brush bar assembly 30 which is mounted within a brush bar chamber 32 of the housing 18. The brush bar assembly 30 is driven by a motor located in a motor housing 34 of the housing 18. The brush bar assembly 30 is connected to the motor by a drive mechanism located within a drive mechanism housing 36 so that the drive mechanism is isolated from the air passing through the suction passage. In this example, the drive mechanism comprises a drive belt for connecting the motor to the brush bar assembly 30. To provide a balanced cleaner head in which the weight of the motor is spread evenly about the bottom surface of the sole plate 20, the motor housing 34 is located centrally above, and rearward of, the brush bar chamber 32. Consequently, the drive mechanism housing 36 extends into the brush bar chamber 32 between the side walls of the brush bar chamber 32.

It will be appreciated that the brush bar assembly 30 can be driven in other ways, such as by a turbine which is driven by an incoming or exhaust air flow, or by a coupling to the motor which is also used to generate the air flow through the vacuum cleaner 10. The coupling between the motor and the brush bar assembly 30 can alternatively be via a geared coupling. The brush bar assembly 30 can be removed entirely so that the vacuum cleaner 10 relies entirely on suction or by some other form of agitation of the floor surface. For other types of surface treating machines, the cleaner head 12 can include appropriate means for treating the floor surface, such as a polishing pad, a liquid or a wax dispensing nozzle.

The main body 14 is connected to a support assembly 16 for allowing the vacuum cleaner 10 to be rolled along a floor surface. The support assembly 16 comprises a pair of wheels 40, 42. Each wheel 40, 42 is dome-shaped, and has an outer surface of substantially spherical curvature. Annular ridges 41 may be provided on the outer surface of each wheel 40, 42 to improve grip on the floor surface. These ridges 41 may be integral with the outer surface of each wheel 40, 42 or, as illustrated, may be separates members adhered or otherwise attached to the outer surface of each wheel 40, 42. Alternatively, or additionally, a non-slip texture or coating may be provided on the outer surface of the wheels 40, 42 to aid grip on slippery floor surfaces such as hard, shiny or wet floors.

The outer surfaces of the wheels 40, 42 (that is, excluding the optional ridges 41) at least partially delimit a substantially spherical volume V. The rotational axes $R_1$, $R_2$ of the wheels 40, 42 are inclined downwardly relative to an axis A passing horizontally through the center of the spherical volume V. Axis A is illustrated in FIGS. 3, 4, 5*a* and 5*b*. Consequently, the rims 40*a*, 42*a* of the wheels 40, 42 provide the lowest extremity of the wheels 40, 42 for making contact with a floor surface 43. A ridge 41 may be formed or otherwise provided at each rim 40*a*, 42*a*. In this example, the angle of the inclination of the rotational axes $R_1$, $R_2$ to the axis A is around 8°, but this angle may take any desired value.

The wheels 40, 42 are rotatably connected to the yoke 26 that connects the cleaner head 12 to the main body 14 of the vacuum cleaner 10, and so the yoke 26 may be considered to form part of the support assembly 16. Each wheel 40, 42 is rotatably connected to a respective wheel axle of the yoke 26 by a respective wheel bearing arrangement. End caps 44, 46 mounted on the wheels 40, 42 inhibit the ingress of dirt into the wheel bearing arrangements, and serve to connect the wheels 40, 42 to the axles.

The yoke 26 also comprises an inlet section 48 of an internal duct for receiving a dirt-bearing air flow from the cleaner head 12. The internal duct passes through the spherical volume V delimited by the wheels 40, 42 of the support assembly 16. The fluid outlet 24 of the cleaner head 12 is connected to the internal duct inlet section 48 in such a manner that allows the fluid outlet 24 to rotate about the internal duct inlet section 48, and thus allows the cleaner head 12 to rotate relative to the main body 14 and the support assembly 16, as the vacuum cleaner 10 is maneuvered over a floor surface during floor cleaning. For example, the fluid outlet 24 of the cleaner head 12 may comprise at least one formation for receiving the internal duct inlet section 48. The fluid outlet 24 of the cleaner head 12 may be retained on the internal duct inlet section 48 by a snap-fit connection. Alternatively, or additionally, a C-clip or other retaining mechanism may be used to releasably retain the fluid outlet 24 of the cleaner head 12 on the internal duct inlet section 48.

Figure 5A:
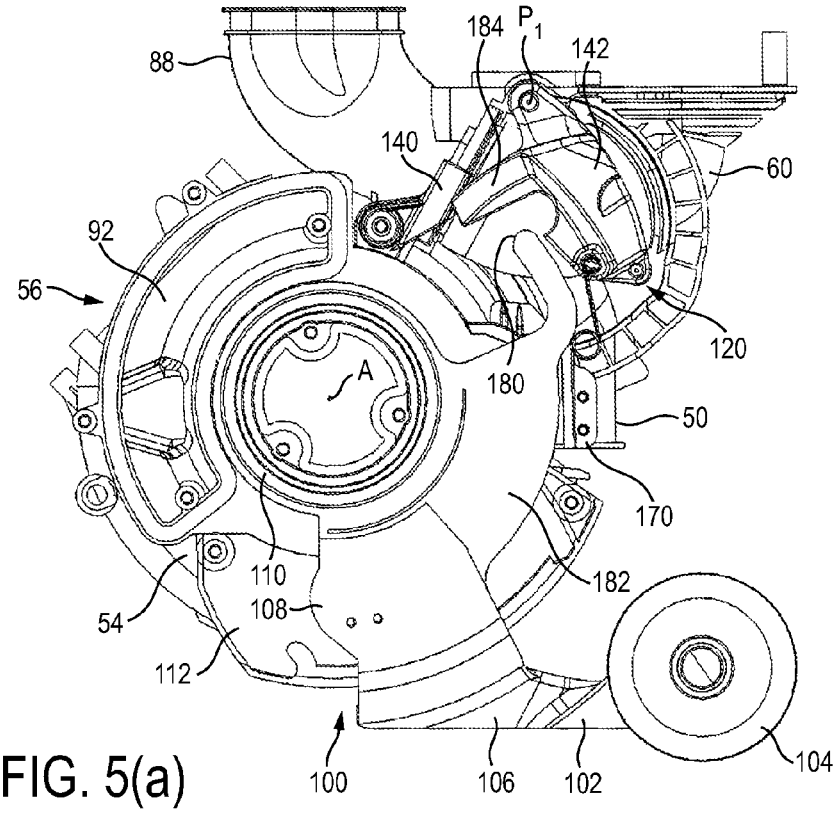
FIG. 5*a* is a left side view of a motor casing and a stand of the vacuum cleaner, and with the stand in a supporting position.
Figure 5B:
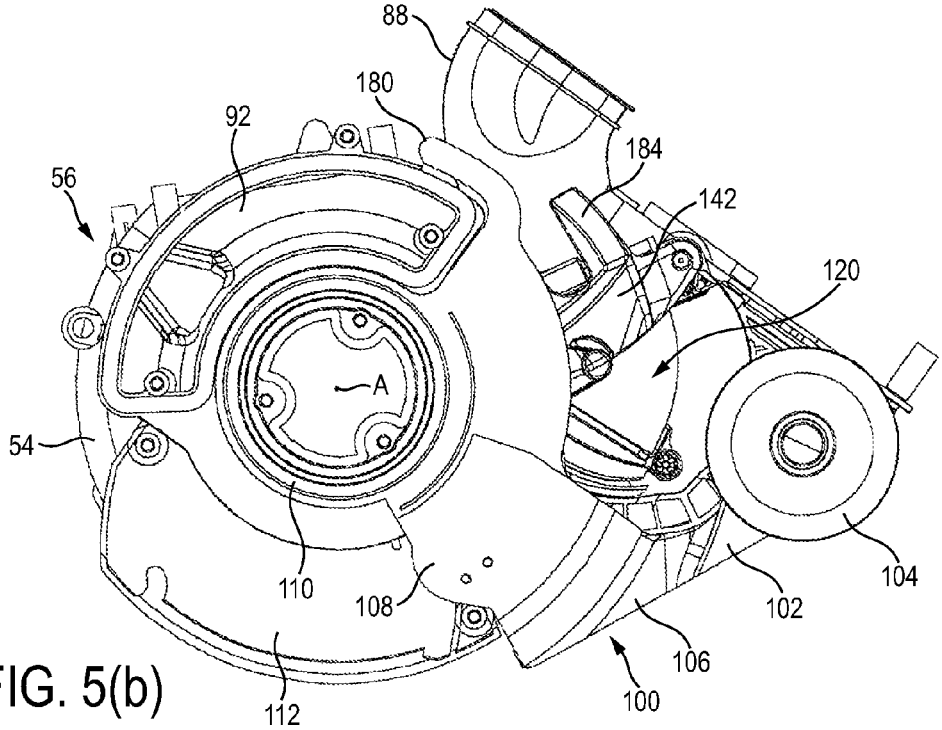
FIG. 5*b* is a left side view of the motor casing and stand of the vacuum cleaner, and with the stand in a retracted position.

With reference also to FIGS. 5*a* and 5*b*, the internal duct further comprises an internal duct outlet section 50 connected to the main body 14 of the vacuum cleaner 10, and a flexible hose 52 (shown in FIG. 3) which extends between the wheels 40, 42 of the support assembly 16 to convey a dirt-bearing air flow to the internal duct outlet section 50. The internal duct outlet section 50 is integral with a first motor casing section 54 of a motor casing 56 housing a motor-driven fan unit (indicated at 57 in FIG. 7*c*) for drawing the airflow through the vacuum cleaner 10. The yoke 26 is pivotably connected to the motor casing 56 for movement relative to the motor casing 56 about the axis A. The motor casing 56 comprises a second motor casing section 58 which is connected to the first motor casing section 54, and which defines with the first motor casing section 54 an airflow path through the motor casing 56. The axis A passes through the motor casing 56 so that the central axis of the fan unit 57, about which an impeller of the fan unit 57 rotates, is co-linear with the axis A.

A number of parts of the main body 14 of the vacuum cleaner 10 are also integral with the first motor casing section 54. One of these parts is an outlet section 60 of a hose and wand assembly 62 of the main body 14. The hose and wand assembly outlet section 60 has a fluid port 60*a* which is angularly spaced from a fluid port 50*a* of the internal duct outlet section 50. With reference again to FIGS. 1, 2*a* and 3, the hose and wand assembly 62 comprises a wand 64 which is releasably connected to the spine 66 of the main body 14, and a flexible hose 68 connected at one end thereof to the wand 64 and at the other end thereof to the hose and wand assembly outlet section 60. The spine 66 of the main body 14 preferably has a concave rear surface so that the wand 64 and the hose 68 may be partially surrounded by the spine 66 when the wand 64 is connected to the main body 14. Cleaning tools 70, 72 for selective connection to the distal end of the wand 64 may be detachably mounted on the spine 66 of the main body 14, or the distal end of the wand 64.

The motor casing 56 is connected to the base of the spine 66 of the main body 14. The spine 66 of the main body 14 comprises a user-operable handle 74 at the end thereof remote from the support assembly 16. An end cap 75 is pivotably connected to the upper surface of the handle 74 for covering the distal end of the wand 64 when the wand 64 is connected to the spine 66 to inhibit user contact with this end of the wand 64 when the wand 64 is connected to the spine 66. A power lead 76 for supplying electrical power to the vacuum cleaner 10 extends into the spine 66 though an aperture formed in the spine 66. Electrical connectors (not shown) extend downwardly within the spine 66 and into the spherical volume V delimited by the wheels 40, 42 to supply power to the fan unit 57. Further electrical connectors extend between the cleaner head 12 and the yoke 26 for supplying power to the motor for driving the brush bar assembly 30.

A first user-operable switch 77*a* is provided on the spine 66 and is arranged so that, when it is depressed, the fan unit 57 is energized. The fan unit 57 may also be de-energized by depressing this first switch 77*a*. A second user-operable switch 77*b* is provided adjacent the first switch 77*a*. The second switch 77*b* enables a user to control the activation of the brush bar assembly 30 when the main body 14 of the vacuum cleaner 10 is reclined away from its upright position.

Figure 2A:
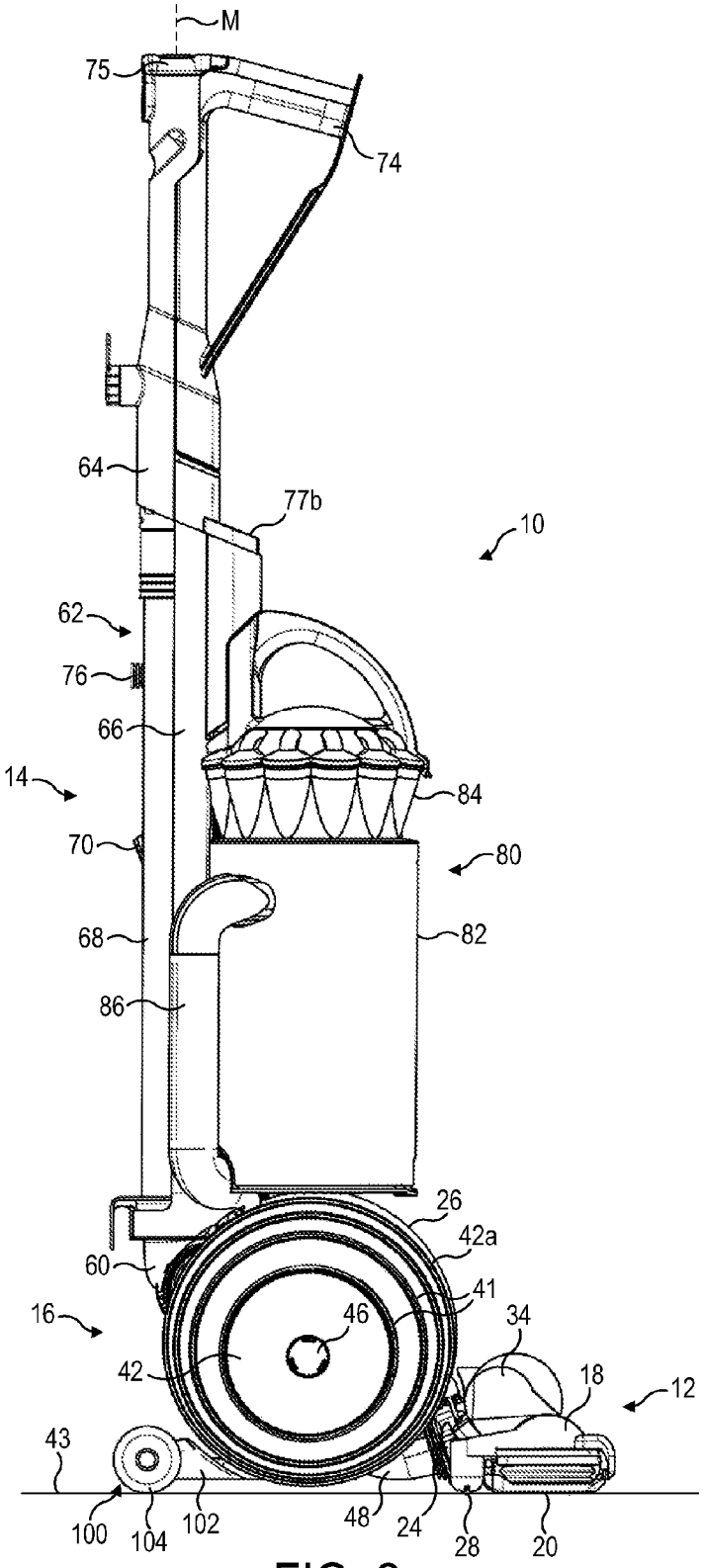
FIG. 2*a* is a right side view of the vacuum cleaner, with the main body of the vacuum cleaner in an upright position.
Figure 3:
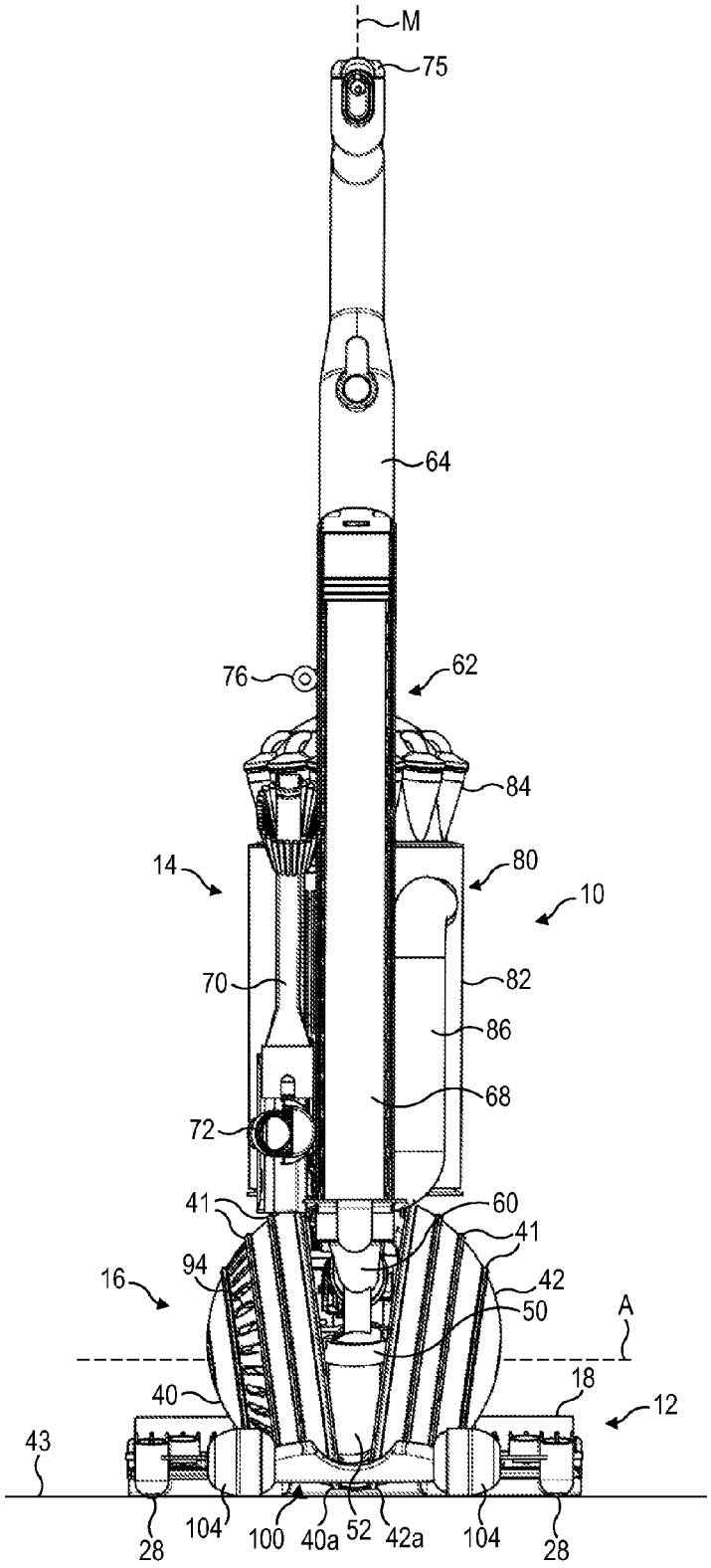
FIG. 3 is a rear view of the vacuum cleaner.

The main body 14 further comprises separating apparatus 80 for removing dirt, dust and/or other debris from a dirt-bearing airflow which is drawn into the vacuum cleaner 10. The separating apparatus 80 can take one of a number of forms. In this example the separating apparatus 80 comprises cyclonic separating apparatus, in which the dirt and dust is spun from the airflow. As is known, the separating apparatus 80 can comprise two or more stages of cyclone separation arranged in series with one another. In this example, a first stage 82 comprises a cylindrical-walled chamber and a second stage 84 comprises a tapering, substantially frusto-conically shaped, chamber or, as illustrated, a set of these tapering chambers arranged in parallel with one another. As illustrated in FIGS. 2*a* and 3, a dirt-bearing airflow is directed tangentially into the upper part of the first stage 82 of the separating apparatus 80 by a separating apparatus inlet duct 86. The separating apparatus inlet duct 86 extends alongside, and is connected to, the spine 66 of the main body 14. The separating apparatus inlet duct 86 is connected to an inlet duct inlet section 88 which also forms an integral part of the first motor casing section 54. The inlet duct inlet section 88 has a fluid port 88*a* which is angularly spaced from the fluid ports 50*a*, 60*a* along a path defined by the first motor casing section 54.

The nature of the separating apparatus 80 is not material to the present invention and the separation of dust from the airflow could equally be carried out using other means such as a conventional bag-type filter, a porous box filter or some other form of separating apparatus. For embodiments of the apparatus which are not vacuum cleaners, the main body can house equipment which is appropriate to the task performed by the machine. For example, for a floor polishing machine the main body can house a tank for storing liquid wax.

The main body 14 comprises a motor inlet duct for receiving an airflow exhausted from the separating apparatus 80 and for conveying this airflow to the motor casing 56. As previously discussed, the fan unit 57 is located between the wheels 40, 42 of the support assembly 16, and so the motor inlet duct extends from an air outlet formed in the base of the separating apparatus 80 and between the wheels 40, 42 of the support assembly 16 to convey the airflow from the separating apparatus 80 to the fan unit 57. The airflow is conveyed from the second stage 84 of cyclonic separation to the air outlet of the separating apparatus 80 by a duct passing through, and co-axial with, the first stage 82 of cyclonic separation. The yoke 26 comprises an aperture in the form of a slot through which a motor inlet duct protrudes so that the air inlet of the motor inlet duct is located beyond the external surface of the yoke 26. The motor inlet duct comprises a spigot upon which the base of the separating apparatus 80 is mounted so that the air inlet of the motor inlet duct is substantially co-axial with the air outlet of the separating apparatus 80.

In this example, the second motor casing section 58 comprising a motor casing air inlet 90 through which the airflow enters the motor casing 56, and the first motor casing section 54 comprises a motor casing air outlet 92 through which the airflow is exhausted from the motor casing 56. This airflow is subsequently exhausted from the vacuum cleaner 10 through a plurality of wheel air outlets 94 formed in the wheel 40 located adjacent the first motor casing section 54, and which are located so as to present minimum environmental turbulence outside of the vacuum cleaner 10.

Figure 4:
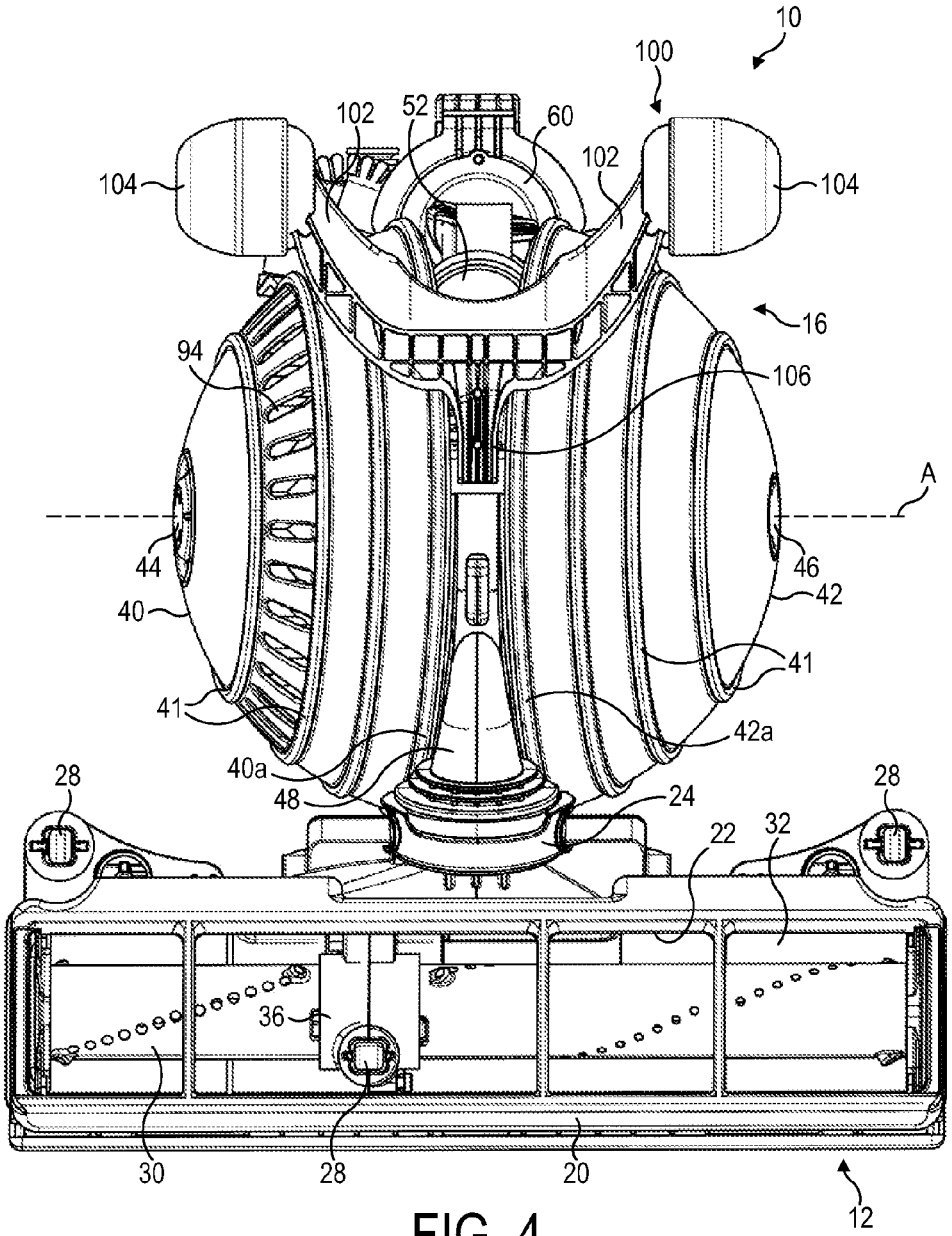
FIG. 4 is a bottom view of the vacuum cleaner.

The support assembly 16 comprises a stand 100 for supporting the main body 14 when it is in its upright position. Returning to FIGS. 1 to 5*b*, the stand 100 comprises two supporting legs 102, each supporting leg 102 having a stabilizer wheel 104 rotatably attached to an axle extending outwardly from the lower end of the supporting leg 102. Each supporting leg 102 is attached to a relatively short body 106 of the stand 100. As illustrated in FIG. 4, the body 106 of the stand 100 protrudes outwardly from between the wheels 40, 42 of the support assembly 16, and so protrudes outwardly from the spherical volume V. The stand 100 further comprises two supporting arms 108 extending outwardly and upwardly from the body 106 of the stand 100. The supporting arms 108 of the stand 100 are located within the spherical volume V, and so cannot be seen in FIGS. 1 to 4. The motor casing 56 is located between the supporting arms 108. The upper end of each supporting arm 108 comprises a respective annular connector 110 for connecting that supporting arm 108 to a respective motor casing section 54, 58.

Each of the annular connectors 110 is rotatably connected to the motor casing 56 so that the annular connectors 110 are orthogonal to the axis A, and so that the axis A passes through the centers of the annular connectors 110. As a result, the stand 100 is pivotable relative to the motor casing 56 about the axis A. The stand 100 is pivotable relative to the motor casing 56, and therefore relative to the main body 14 of the vacuum cleaner 10, between a lowered, supporting position (as shown in FIG. 5*a*) for supporting the main body 14 when it is in its upright position, and a raised, retracted position (as shown in FIG. 5*b*) so that the stand 100 does not interfere with the maneuvering of the vacuum cleaner 10 during floor cleaning. An over-center spring mechanism (not shown) is connected between the motor casing 56 and the stand 100 to assist in moving the stand 100 between its supporting and retracted positions. Depending on the relative angular positions of the motor casing 56 and the stand 100, the over-center spring mechanism either urges the stand 100 towards its supporting position, or urges the stand 100 towards its retracted position.

The vacuum cleaner 10 comprises a stand retaining mechanism (not illustrated) for retaining the stand 100 in its supporting position when the main body 14 is in its upright position. This stand retaining mechanism comprises a stand locking member located within an open-sided housing 112 formed on the outer surface of the first motor casing section 54. The stand locking mechanism further comprises a spring which urges the stand locking member towards a locking position for retaining the stand 100 in its upright position. The stand 100 comprises a stand pin (not illustrated) which extends inwardly from the supporting arm 108 located adjacent the housing 112 for engaging the stand locking member. The weight of the main body 14 acting on the stand 100 tends to urge the stand 100 towards its raised, retracted position, against the biasing force of the torsion spring, so that the stand pin bears against the stand locking member. The biasing force of the spring is chosen so that the stand locking member is able to retain the stand 100 in its supporting position when the main body 14 is in its upright position.

A changeover valve assembly 120 is attached to the first motor casing section 54. The changeover valve assembly 120 connects the fluid port 88*a* of the inlet duct inlet section 88 to a selected one of the fluid port 50*a* of the internal duct outlet section 50 and the fluid port 60*a* of the hose and wand assembly outlet section 60. The changeover valve assembly 120 can adopt a first configuration, as illustrated in FIGS. 5*a*, 7*a*, 7*b* and 7*c*, in which the fluid port 88*a* is connected to the fluid port 60*a* so that when the user depresses the first switch 77*a* to activate the fan unit 57 a dirt-bearing airflow is drawn into the vacuum cleaner 10 through the distal end of the wand 64. The dirt-bearing airflow passes through the hose and wand assembly 62 and is conveyed by the changeover valve assembly 120 into the separating apparatus inlet duct 86. This first configuration is adopted by the changeover valve assembly 120 when the main body 14 is in an upright position and the stand 100 is in its supporting position relative to the main body 14, as shown in FIG. 2*a*.

Figure 2B:
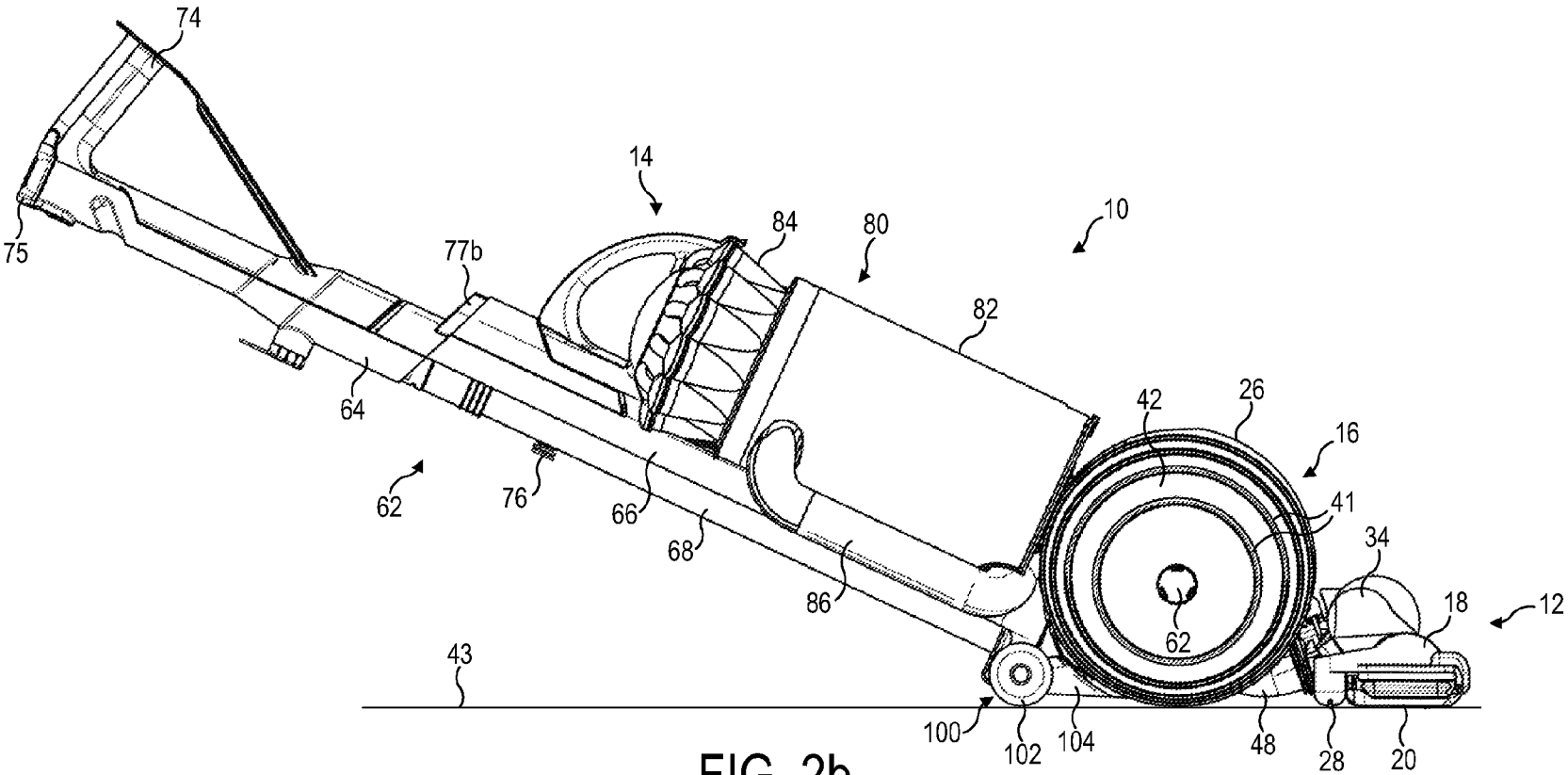
FIG. 2*b* is a right side view of the vacuum cleaner, with the main body in a fully reclined position.
Figure 8A:
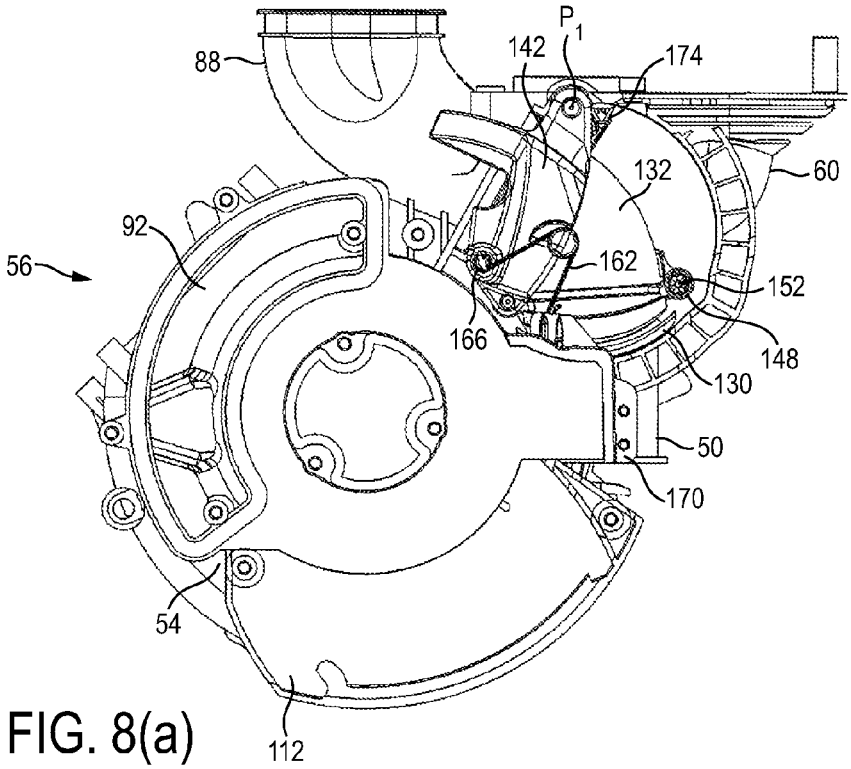
FIG. 8*a* is a left side view of the motor casing, with the changeover valve assembly in a second configuration.
Figure 8B:
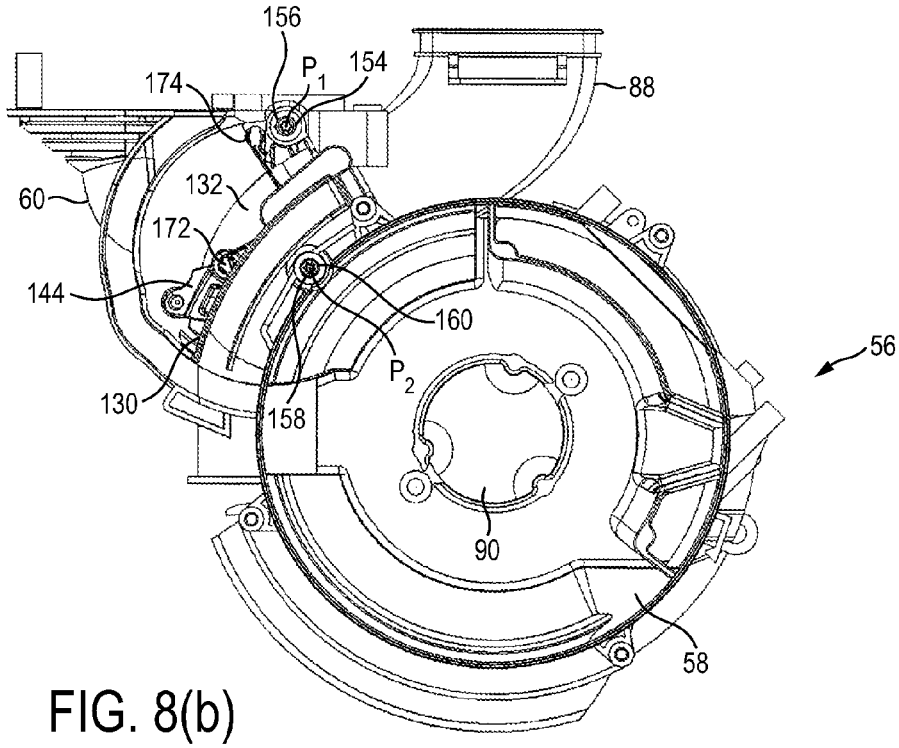
FIG. 8*b* is a right side view of the motor casing, with the changeover valve assembly in the second configuration.

The changeover valve assembly 120 can also adopt a second configuration, as illustrated in FIGS. 5*b*, 8*a* and 8*b*, in which the fluid port 88*a* is connected to the fluid port 50*a* so that when the user depresses the first switch 77*a* to activate the fan unit 57 a dirt-bearing airflow is drawn into the vacuum cleaner 10 through the suction opening 22 of the cleaner head 12. The dirt-bearing airflow passes through the cleaner head 12 and the internal duct within the support assembly 16, and is conveyed by the changeover valve assembly 120 into the separating apparatus inlet duct 86. This second configuration is adopted by the changeover valve assembly 120 when the main body 14 is in a reclined position and the stand 100 is in its retracted position relative to the main body 14, as shown in FIG. 2*b*.

Figure 6:
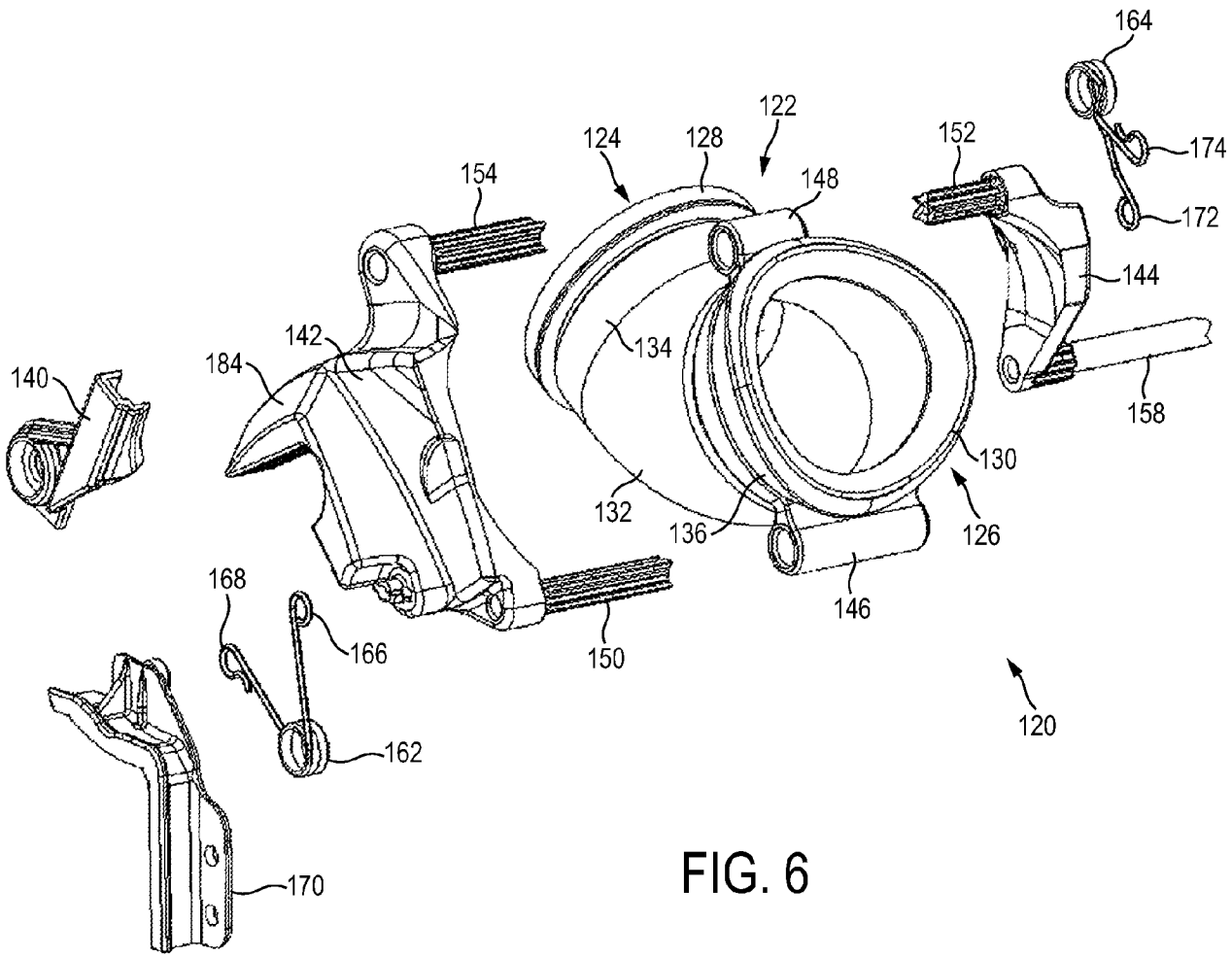
FIG. 6 is an exploded view of the components of a changeover valve assembly of the vacuum cleaner.

The components of the changeover valve assembly 120 are illustrated in FIG. 6. The changeover valve assembly 120 comprises a duct assembly 122 having a first end 124 and a second end 126 located opposite to the first end 124. A first annular seal 128 is located at the first end 124 of the duct assembly 122, and a second annular seal 130 is located at the second end 126 of the duct assembly 122. A flexible duct 132, preferably in the form of a hose, extends between the seals 128, 130. The first seal 128 is connected to a first annular seal carrier 134 which is in turn connected to one end of the duct 132, for example by overmolding. The second seal 130 is connected to a second annular seal carrier 136 which is in turn connected to the other end of the duct 132, for example by overmolding.

Figure 7A:
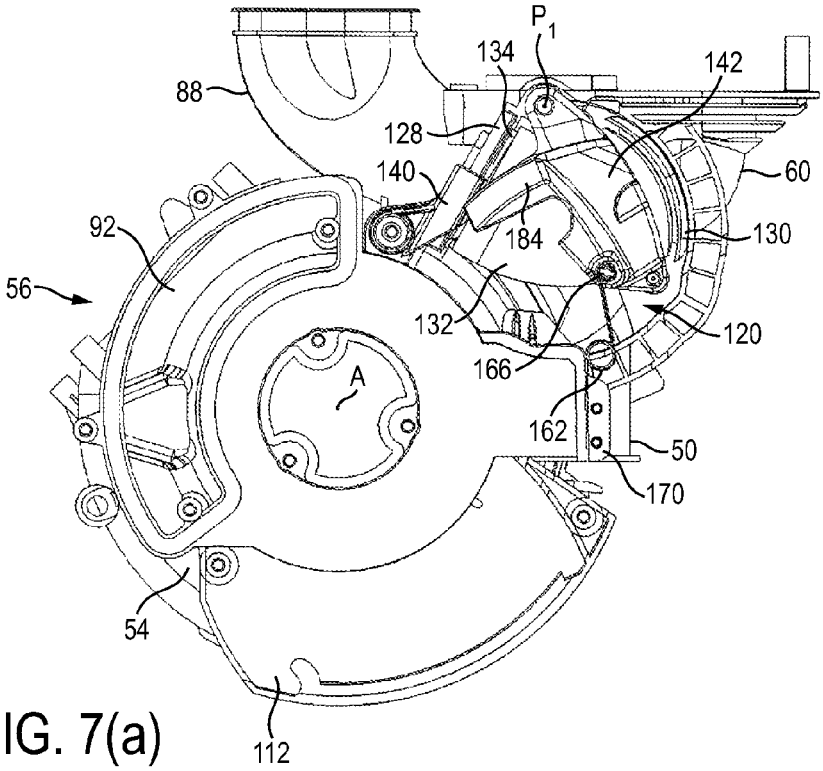
FIG. 7*a* is a left side view of the motor casing, with the changeover valve assembly in a first configuration.
Figure 7B:
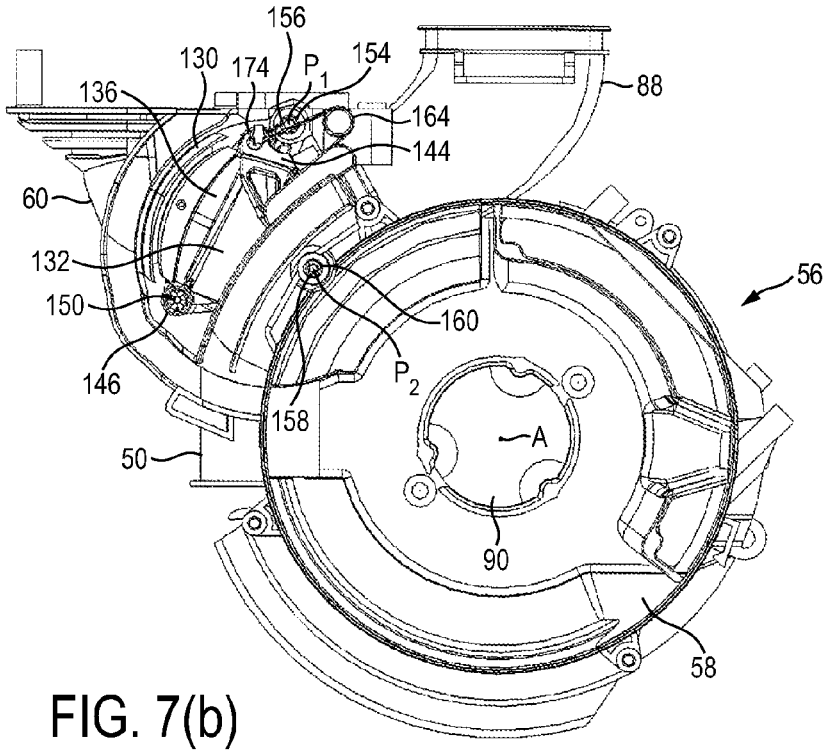
FIG. 7*b* is a right side view of the motor casing, with the changeover valve assembly in the first configuration.
Figure 7C:
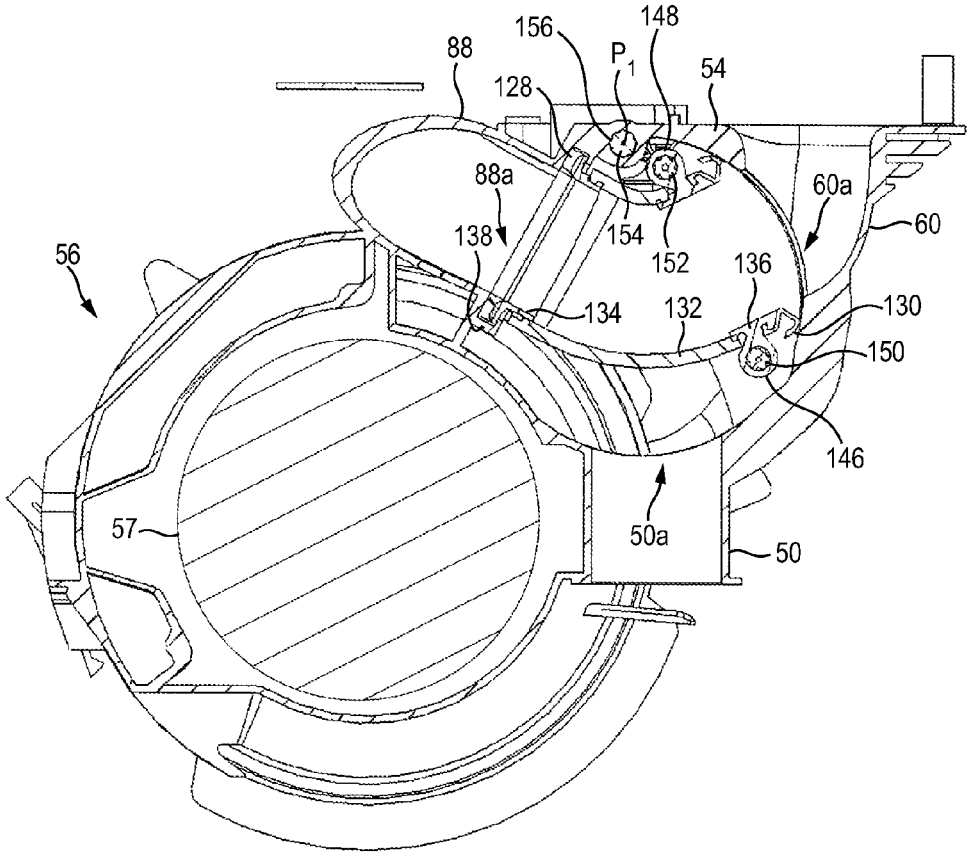
FIG. 7*c* is a side sectional view through the motor casing.

With reference also to FIG. 7*c*, the first end 124 of the duct assembly 122 is inserted into a slot 138 formed in the first motor casing section 54 so that the first seal 128 is compressed against the inlet duct inlet section 88 to form an air-tight seal between the separating apparatus inlet duct 86 and the duct assembly 122. The changeover valve assembly 120 comprises a duct securing member 140 which is attached to the first motor casing section 54, and which urges the first end 124 of the duct assembly 122 into the slot 138 to retain the first end 124 of the duct assembly 122 in a stationary position relative to the first motor casing section 54.

Returning to FIG. 6, the changeover valve 120 further comprises a first support 142 and a second support 144 for supporting the duct assembly 122. The first support 142 is connected to a first connector 146 of the duct assembly 122, and the second support 144 is connected to a second connector 148 of the duct assembly 122 so that the supports 142, 144 are located on opposite sides of the duct assembly 122. Each connector 146, 148 is connected to, and is preferably integral with, the second seal carrier 136 of the duct assembly 122 so that the connectors 146, 148 are located towards the second end 126 of the duct assembly 122, and on opposite sides of the duct assembly 122. Each connector 146, 148 is preferably in the form of a female connector for receiving a male connector connected to a respective support 142, 144. In this example, each support 142, 144 comprises a first shaft 150, 152 which is inserted into a bore of a respective connector 146, 148 of the duct assembly 122. The bores of the connectors 146, 148 are substantially parallel.

The first support 142 is connected to the first motor casing section 54 so that the first support 142 is pivotable relative to the motor casing 56 about a first pivot axis $P_1$. In this example, the first support 142 comprises a second shaft 154 which is inserted into a first bore 156 formed in the first motor casing section 54. The second shaft 154 is substantially parallel to the first shaft 150. The first bore 156 extends along the first pivot axis $P_1$ so that the second shaft 154 rotates about the first pivot axis $P_1$ as the first support 142 moves relative to the motor casing 56.

The second support 144 is connected to the first motor casing section 54 so that the second support 144 is pivotable relative to the motor casing 56 about a second pivot axis $P_2$ spaced from the first pivot axis $P_1$. In this example, the second support 144 comprises a second shaft 158 which is inserted into a second bore 160 formed in the first motor casing section 54. The second shaft 158 is substantially parallel to the first shaft 152 of the second support 144. The second bore 160 extends along the second pivot axis $P_2$ so that the second shaft 158 rotates about the second pivot axis $P_2$ as the second support 142 moves relative to the motor casing 56. The second bore 160 is substantially parallel to the first bore 156 so that the second pivot axis $P_2$ is substantially parallel to the first pivot axis $P_1$. The pivot axes $P_1$, $P_2$ are substantially parallel to the axis A passing horizontally through the center of the spherical volume V.

When the changeover valve assembly 120 is in the first configuration illustrated in FIGS. 5*a*, 7*a*, 7*b* and 7*c*, the second end 126 of the duct assembly 122 is in a first position which allows fluid flow between the hose and wand assembly 62 and the fan unit 57. The second seal 130, located at the second end 126 of the duct assembly 122, is seated over the fluid port 60*a*. The second end 126 of the duct assembly 122 is biased towards the first position to maintain an air-tight seal between the hose and wand assembly outlet section 60 and the second seal 130.

The changeover valve assembly 120 comprises an over-center spring arrangement for biasing the second end 126 of the duct assembly 122 towards the first position. In this example, this spring arrangement comprises a first helical torsion spring 162 and a second helical torsion spring 164. The first torsion spring 162 has a first end 166 connected to the first support 142 and a second end 168 connected to a stationary spring mount 170, which is in turn connected to the first motor casing section 54. The biasing force of the first torsion spring 162 urges apart the ends 166, 168 of the first torsion spring 162 so that, in this first configuration, the first support 142 is urged to pivot about the first pivot axis $P_1$ in such a direction (anticlockwise as viewed in FIG. 7*a*) that urges the second seal 130 against the hose and wand assembly outlet section 60. The second torsion spring 164 has a first end 172 connected to the second support 144 and a second end 174 connected to the first motor casing section 54. The biasing force of the second torsion spring 164 urges apart the ends 172, 174 of the second torsion spring 162 so that, in this first configuration, the second support 144 is urged to pivot about the second pivot axis $P_2$ in such a direction (clockwise as viewed in FIG. 7*b*) that urges the second seal 130 against the hose and wand assembly outlet section 60.

With the changeover valve assembly 120 in its first configuration, a dirt-bearing airflow passes through the hose and wand assembly 62 and is conveyed by the dust assembly 122 into the separating apparatus inlet duct 86. The dirt-bearing airflow is conveyed by the separating apparatus inlet duct 86 into the separating apparatus 80. Larger debris and particles are removed and collected in the chamber of the first stage 82 of cyclonic separation. The airflow then passes through a shroud to a set of smaller frusto-conically shaped cyclonic chambers of the second stage 84 of cyclonic separation. Finer dust is separated from the airflow by these chambers of the second stage, and the separated dust is collected in a common collecting region of the separating apparatus 80. An airflow is exhausted from the air outlet formed in the base of the separating apparatus 80, and is conveyed to the motor casing 56 by the motor inlet duct. The airflow passes through the motor casing 56 and the fan unit 57, and is exhausted from the motor casing 56 through the motor casing air outlet 92. The airflow passes through a filter (not shown) before being exhausted from the vacuum cleaner 10 through the wheel air outlets 94.

The main body 14 of the vacuum cleaner 10 is moveable between an upright position, illustrated in FIG. 2*a*, and a fully reclined position, illustrated in FIG. 2*b*. In this example, when the vacuum cleaner 10 is located on a substantially horizontal floor surface 43 with both the wheels 28 of the cleaner head 12 and the stabilizer wheels 104 of the stand 100 in contact with the floor surface, the longitudinal axis M of the spine 66 of the main body 14 is substantially orthogonal to the floor surface 43 when the main body 14 is in its upright position. Of course, the main body 14 may be inclined backwards or forwards slightly towards the floor surface 43 when in its upright position.

The rotational attachment of the yoke 26 and the stand 100 to the motor casing 56 allows the main body 14, which includes the motor casing 56, the hose and wand assembly 62, the spine 66 and the motor inlet duct, to be rotated about the axis A relative to the cleaner head 12, and the yoke 26, wheels 40, 42 and stand 100 of the support assembly 16. The axis A may thus also be considered as a pivot axis about which the main body 14 may be reclined away from its upright position. Consequently, as the main body 14 is reclined from its upright position to its fully reclined position the bottom surface of the cleaner head 12 may be maintained in contact with the floor surface. In this example, the main body 14 pivots by an angle of around 65° about the pivot axis A as it is reclined from its upright position to its fully reclined position.

The main body 14 is reclined when the vacuum cleaner 10 is to be used to clean a floor surface. The rotation of the main body 14 of the vacuum cleaner 10 from its upright position is initiated by the user pulling the handle 74 of the main body 14 towards the floor surface while simultaneously pushing the handle 74 downwardly, along the longitudinal axis M of the spine 66 of the main body 14, both to increase the load bearing on the stand 100 and to maintain the bottom surface of the cleaner head 12 in contact with the floor surface. As the main body 14 is reclined relative to the floor surface, the motor casing 56 rotates about the axis A, relative to the support assembly 16. Initially, the stabilizer wheels 104 of the stand 100 remain in contact with the floor surface. Consequently the force acting between the stand locking member and the stand pin increases. The increase in this force is due to both the increased load acting on the stabilizer wheels 104 and the application of a torque to the main body 14. As the user continues to recline the main body 14 towards the floor surface, the torque applied to the main body 14 increases. Eventually, the force acting between the stand locking member and the stand pin becomes sufficiently high as to cause the stand locking member to move, against the biasing force of the spring of the stand locking mechanism, to release the stand 100. In this example, the stand 100 becomes released by the stand retaining mechanism when the main body 14 has been reclined from its upright position by an angle of around 5°.

Once the stand 100 has been released by the stand retaining mechanism, the main body 14 can be reclined fully towards the floor surface by the user while maintaining the bottom surface of the cleaner head 12 in contact with the floor surface. The main body 14 is preferably arranged so that its center of gravity is located behind the stabilizer wheels 104 of the stand 100 once the stand 100 has become disengaged from the stand retaining mechanism. Consequently, the weight of the main body 14 tends to assist the user in reclining the main body 14 towards its fully reclined position.

Following its release from the stand retaining mechanism, the stand 100 does not automatically move to its retracted position. Instead, as the main body 14 is reclined towards its fully reclined position following the release of the stand 100 from the stand retaining mechanism, initially the stabilizer wheels 104 of the stand 100 remain in contact with the floor surface, and so the main body 14 continues to pivot about axis A relative to the stand 100.

The movement of the changeover valve assembly 120 between its first and second configuration is actuated by the stand 100 as the main body 14 is reclined from its upright position. Returning to FIGS. 5*a* and 5*b*, the supporting arm 108 which is located adjacent the first support 142 of the changeover valve assembly 120 comprises a drive pin 180 extending inwardly from a raised section 182 of the supporting arm 108 for engaging a profiled drive section 184 of the first support 142. The drive pin 180 is positioned so that it is spaced from the drive section 184 when the main body 14 is in its upright position. As the main body 14 is reclined towards the floor surface, the movement of the motor casing 56 relative to the stand 100 about the axis A causes the drive pin 180 to engage the drive section 184 of the first support 142. In this example, the drive pin 180 engages the drive section 184 once the main body 14 has been reclined by an angle of around 5-10° from its upright position.

As the main body 14 is reclined further from the upright position, the relative movement between the motor casing 56 and the stand 100 causes the drive pin 180 to push the drive section 184 upwardly so that the first support 142 pivots about the first pivot axis $P_1$ against the biasing force of the first torsion spring 162. Due to the connection between the first support 142 and the second seal carrier 136, this movement of the first support 142 about the first pivot axis $P_1$ causes the second end 126 of the duct assembly 122 to move away from its first position, breaking the seal formed between the hose and wand assembly outlet section 60 and the second seal 130. Furthermore, due to the connection between the second support 144 and the second seal carrier 136, the movement of the first support 142 about the first pivot axis $P_1$ also causes the second support 144 to pivot about the second pivot axis $P_2$ against the biasing force of the second torsion spring 164.

Figure 9A:
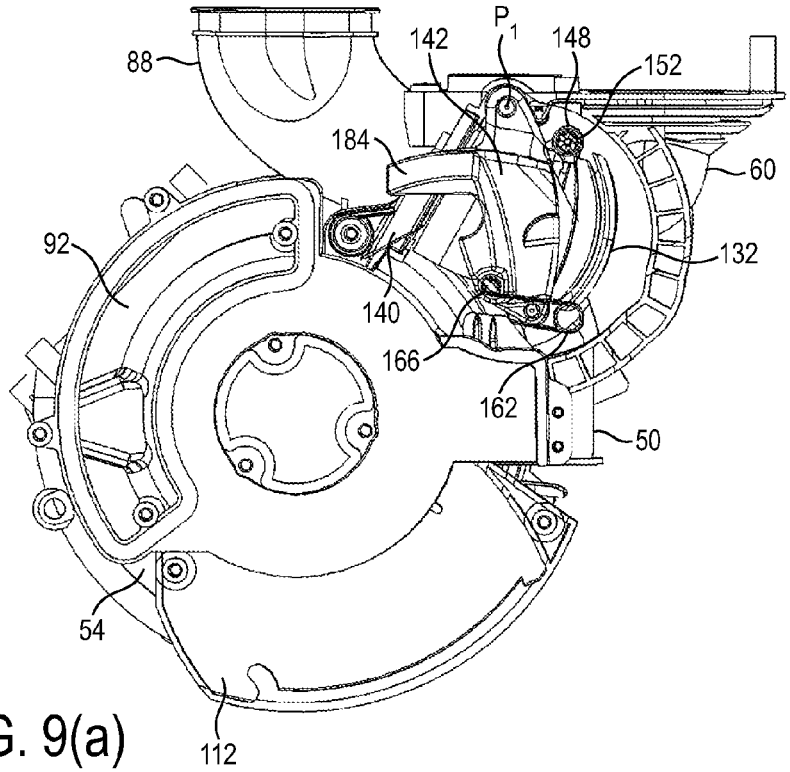
FIG. 9*a* is a left side view of the motor casing, with the changeover valve assembly in a third configuration intermediate the first and second configurations.
Figure 9B:
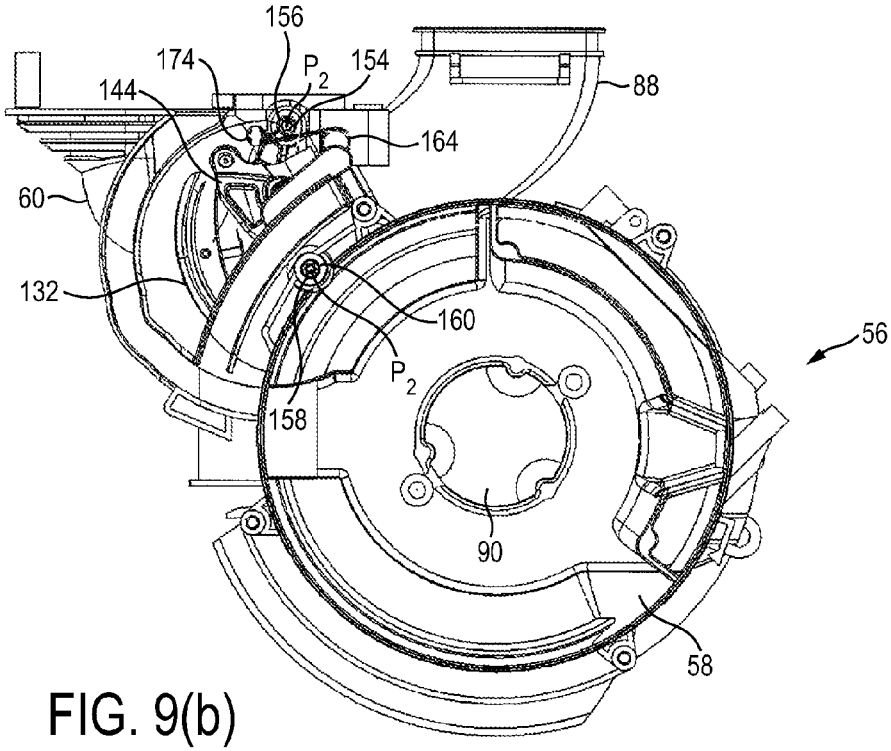
FIG. 9*b* is a right side view of the motor casing, with the changeover valve assembly in the third configuration.

The torsion springs 162, 164 are each connected between the motor casing 56 and a respective one of the supports 142, 144 so that the spacing between the ends 166, 168 of the first torsion spring 162, and the spacing between the ends 172, 174 of the second torsion spring 164, varies as the main body 14 is pivoted about axis A. In this example, these spacings reach a minimum, and so each torsion spring 162, 164 is at an over-center point, when the main body 14 has been reclined by an angle of around 15° from its upright position. FIGS. 9*a* and 9*b* illustrate the positions of the duct assembly 122 and the supports 142, 144 when the main body 14 has been reclined so that the torsion springs 162, 164 are at their over-center points.

As the main body 14 is reclined further, each torsion spring 162, 164 moves beyond its over-center point so that the biasing force of the torsion springs 162, 164 urges apart the ends of the torsion springs 162, 164. This results in the rapid rotation of each support 142, 144 about its respective pivot axis $P_1$, $P_2$ so that the second end 126 of the duct assembly 122 moves rapidly to a second position, as illustrated in FIGS. 8*a* and 8*b*, in which the second seal 130 is seated over the fluid port 50*a*. The drive section 184 of the first support 142 is shaped so that the drive pin 180 of the stand 100 does not impair this pivoting movement of the first support 142 under the action of the first torsion spring 162. In this second configuration of the changeover valve assembly 120, the second end 126 of the duct assembly 122 is biased towards the second position by the torsion springs 162, 164 to maintain an airtight seal between the internal duct outlet section 50 and the second seal 130.

Figure 10:
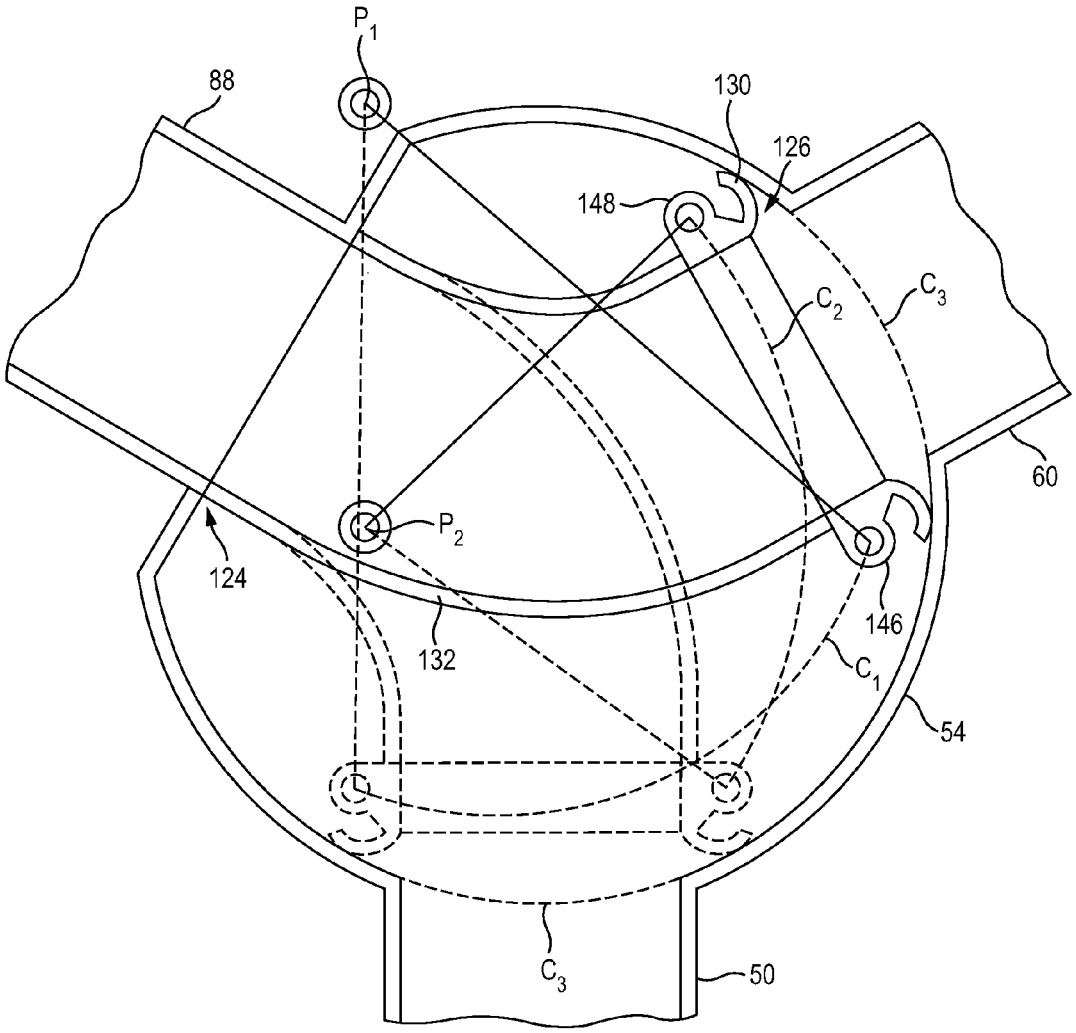
FIG. 10 is an illustration showing the pivoting movement of the changeover valve assembly between the first and second configurations.

As mentioned above, the second pivot axis $P_2$ is spaced from the first pivot axis $P_1$. In this example, the first pivot axis $P_1$ is located above the second pivot axis $P_2$. As illustrated in FIG. 10, the first pivot axis $P_1$ is located above the duct assembly 122, while the second pivot axis $P_2$ passes through the duct assembly 122. The positions of the pivot axes $P_1$, $P_2$ and the lengths of the supports 142, 144 are selected so that as the second end 126 of the duct assembly 122 moves between its first and second positions, the first connector 146 is swept about a first arc $C_1$, and the second connector 148 is swept about a second arc $C_2$. The arcs $C_1$, $C_2$ are not concentric, and each has a respective different radius and length. Each arc $C_1$, $C_2$ is located within a generally circular path $C_3$ which extends between the fluid ports 50*a*, 60*a*. The arcs $C_1$, $C_2$ are arranged within the circular path $C_3$ so that as the second end 126 of the duct assembly 122 moves from one of the first and second positions towards the other of the first and second positions, the initial portion of the arc $C_1$, $C_2$ along which each connector 146, 148 is moved extends away from the circular path $C_3$. For example, as the second end 126 of the duct assembly 122 moves from the first position to the second position, the first connector 146 moves along the first arc $C_1$ away from the circular path $C_3$, and the second connector 148 moves along the second arc $C_2$ away from the circular path $C_3$.

This enables the second seal 130 to be moved rapidly out of contact with the first motor casing section 54 with only a minimal angular movement of the second seal 130 relative to the first motor casing section 54. This can minimize the wear of the second seal 130 as the second end of the duct assembly 122 is moved between its first and second positions.

The movement of the changeover valve assembly 120 from the first position to the second position occurs while the stand 100 is in its supporting position. As mentioned above, an over-center spring mechanism (not shown) is connected between the motor casing 56 and the stand 100 to assist in moving the stand 100 between its supporting and retracted positions. This spring mechanism preferably also comprises a torsion spring, with the spacing between the ends of this torsion spring varying as the main body 14 is pivoted about axis A. In this example, this spacing reaches a minimum, and so the torsion spring is at its over-center point, when the main body 14 has been reclined by an angle of around 35° from its upright position. As the main body 14 is reclined further beyond this angle, the biasing force of the torsion spring urges apart the ends of the torsion spring, which results in the automatic rotation of the stand 100 about the axis A to its raised, retracted position, as illustrated in FIG. 5*b*, in which the stabilizer wheels 104 are raised above the floor surface.

In use, with the main body 14 is in a reclined position and the changeover valve assembly 120 is in its second configuration, the second end 126 of the duct assembly 122 is seated over the fluid port 50*a* so that the second seal 130 is in sealing contact with the internal duct outlet section 50. Consequently, a dirt-bearing airflow is drawn into the vacuum cleaner 10 through the suction opening 22 of the cleaner head 12. The duct 132 of the duct assembly 122 serves to isolate the hose and wand assembly 62 from the fan unit 57 so that substantially no air is drawn into the vacuum cleaner 10 through the distal end of the wand 64. The dirt-bearing airflow passes through the cleaner head 12 and the internal duct, and is conveyed by the duct assembly 122 into the separating apparatus inlet duct 86. The subsequent passage of the airflow through the vacuum cleaner 10 is as discussed above when the main body 14 is in its upright position.

With the main body 14 in a reclined position and the stand 100 in its retracted position, the vacuum cleaner 10 can be moved in a straight line over a floor surface by simply pushing or pulling the handle 74 of the main body 14. With the pivot axis A of the main body 14 substantially parallel to the floor surface, both of the wheels 40, 42 engage the floor surface, and so rotate as the vacuum cleaner 10 is maneuvered over the floor surface. The pivotal mounting of the yoke 26 to the main body 14 allows the bottom surface 20 of the cleaner head 12 to be maintained in contact with the floor surface as the main body 14 is maneuvered over the floor surface.

When the user wishes to return the main body 14 of the vacuum cleaner 10 to its upright position, for example upon completing floor cleaning, the user raises the handle 74 so that the main body 14 pivots about the pivot axis A towards its upright position. As mentioned above, when the main body 14 is in its upright position the longitudinal axis M of the main body 14 is substantially vertical when the vacuum cleaner 10 is located on a horizontal floor surface. As the main body 14 is returned to its upright position, the motor casing 56 and the stand 100 move relative to the yoke 26. Meshing gears located on the yoke 26 and the stand 100 can induce movement of the stand 100 towards its supporting position, against the biasing force of the over-center spring mechanism, as the motor casing 56 and stand 100 are moved relative to the yoke 26. Alternatively, the user may simply depress the stand 100 using a foot to urge the stand 100 back towards its supporting position as the main body 14 is raised to its upright position.

The rotation of the stand 100 back to its supporting position also causes the changeover valve assembly 120 to be driven back to its first configuration through engagement between the drive pin 180 of the stand 100 and the drive section 184 of the first support 142. The movement of the second end 126 of the duct assembly 122 from its second position to its first position is the reverse of its movement from the first position to the second position. Initially, the second end 126 of the duct assembly 122 moves from its second position towards its first position against the biasing force of the torsion springs 162, 164. Once the torsion springs 162, 164 have moved beyond their over-center points, the biasing force of the torsion springs 162, 164 urges apart the ends of the torsion springs 162, 164. This results in the rapid rotation of each support 142, 144 about its respective pivot axis $P_1$, $P_2$, resulting in the rapid movement of the second end 126 of the duct assembly 122 to its first position.

As the stand 100 moves towards its supporting position, the stand pin engages the stand locking member of the stand locking mechanism. The spring of the stand locking mechanism is arranged so that the torque that has to be applied to the main body 14 by the user in order to move the stand pin relative to stand locking member as the stand 100 is urged towards the supporting position is significantly less than that which is required to release the stand 100 from the stand retaining mechanism. The stand locking member is caused to pivot relative to the motor casing 56 to allow the stand pin to slide over the stand locking member so that the stand 100 is again retained in its supporting position by stand locking member. The main body 14 may now be returned to its upright position by the user so that the stabilizer wheels 104 contact the floor surface. The vacuum cleaner 10 may be maneuvered over a floor surface by pulling the handle 74 downward so that the vacuum cleaner 10 tilts backwards on the stabilizer wheels 104 of the stand 100, raising the bottom surface of the cleaner head 12 from the floor surface.

The invention claimed is:

1. A surface treating appliance comprising:

a surface treating head;

a hose;

a fan unit for generating a flow of fluid;

a duct assembly having a first end and a second end moveable relative to the first end between a first position allowing fluid flow between the hose and the fan unit, and a second position allowing fluid flow between the surface treating head and the fan unit;

a plurality of supports for supporting the duct assembly, comprising a first support connected to the duct assembly and which is pivotable about a first axis, and a second support connected to the duct assembly and which is pivotable about a second axis spaced from the first axis; and a drive for effecting the pivoting movement of the supports about their axes to move the second end of the duct assembly between the first and second positions.

2. The appliance of claim 1, wherein the duct assembly comprises a first connector for connecting the first support to the duct assembly, and a second connector for connecting the second support to the duct assembly.

3. The appliance of claim 2, wherein the connectors are located on opposite sides of the duct assembly.

4. The appliance of claim 2, wherein the connectors are located at or towards the second end of the duct assembly.

5. The appliance of claim 1, wherein the duct assembly comprises a flexible duct.

6. The appliance of claim 2, wherein the duct assembly comprises a flexible duct, a seal carrier and an annular seal connected to the seal carrier and located at the second end of the duct assembly, and wherein the connectors are connected to the seal carrier.

7. The appliance of claim 1, wherein the supports are located on opposite sides of the duct assembly.

8. The appliance of claim 1, wherein the supports are of different lengths.

9. The appliance of claim 1, wherein the first axis is located above the second axis.

10. The appliance of claim 1, wherein the drive is located on a stand of the appliance, the drive being arranged to induce pivoting movement of the supports with relative movement between the stand and the supports.

11. The appliance of claim 1, wherein the drive comprises a drive member for inducing pivoting movement of the first support about the first axis.

12. The appliance of claim 11, wherein the drive member is arranged to engage a slot on the first support.

13. The appliance of claim 1, wherein the second end of the duct assembly is biased towards the first and second positions.

14. The appliance of claim 13, comprising a first resilient member connected to the first support, and a second resilient member connected to the second support.

15. The appliance of claim 1, comprising a body having a first port in fluid communication with the surface treating head, a second port in fluid communication with the hose, and a third port in fluid communication with the fan unit.

16. The appliance of claim 15, wherein the first end of the duct assembly is seated over the third port.

17. The appliance of claim 15, wherein the ports are spaced about a path, and wherein both the first axis and the second axis are spaced from the center of the path.

18. The appliance of claim 15, wherein each support is pivotably connected to the body.

* * * * *